US011244617B1

(12) United States Patent
Xi et al.

(10) Patent No.: US 11,244,617 B1
(45) Date of Patent: Feb. 8, 2022

(54) DISPLAY DEVICE AND DRIVING METHOD OF THE SAME

(71) Applicant: AU Optronics Corporation, Hsin-Chu (TW)

(72) Inventors: Peng-Bo Xi, Hsin-Chu (TW); Chen-Chi Lin, Hsin-Chu (TW); Chia-Che Hung, Hsin-Chu (TW); Cheng-Nan Yeh, Hsin-Chu (TW); Chin-Tang Chuang, Hsin-Chu (TW); En-Chih Liu, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/214,967

(22) Filed: Mar. 29, 2021

(30) Foreign Application Priority Data

Sep. 9, 2020 (TW) ..... 109130964

(51) Int. Cl.
*G09G 3/3233* (2016.01)

(52) U.S. Cl.
CPC ... *G09G 3/3233* (2013.01); *G09G 2300/0819* (2013.01); *G09G 2310/08* (2013.01); *G09G 2320/0247* (2013.01); *G09G 2320/064* (2013.01); *G09G 2320/10* (2013.01)

(58) Field of Classification Search
CPC ..... G09G 3/3233; G09G 2300/0819; G09G 2320/064
See application file for complete search history.

(56) References Cited

U.S. PATENT DOCUMENTS 4,958,915 A * 9/1990 Okada ..... G02F 1/133604 345/102
10,713,996 B2 * 7/2020 Kim ..... G09G 3/2011
11,062,655 B2 * 7/2021 Yin ..... G09G 3/3258
2002/0154088 A1 * 10/2002 Nishimura ..... G09G 3/342 345/102
2004/0051692 A1 * 3/2004 Hirakata ..... H05B 41/3927 345/102
2004/0246242 A1 * 12/2004 Sasaki ..... G09G 3/342 345/204
2016/0117999 A1 * 4/2016 Hayashi ..... G09G 3/3406 345/691
2020/0202782 A1 * 6/2020 Huangfu ..... G09G 3/3225

FOREIGN PATENT DOCUMENTS

CN 1005244300 8/2009

* cited by examiner

*Primary Examiner* — Kenneth B Lee, Jr.
(74) *Attorney, Agent, or Firm* — WPAT, PC

(57) ABSTRACT

A driving method applicable to a display device, in which the display device includes multiple pixel circuits, and the method includes: adjusting multiple control signals according to a first display data such that the pixel circuits generate a first frame; receiving a second display data generated after the display data; and adjusting the control signals according to a time duration of the first frame such that the pixel circuits generate a second frame, where brightness for each of the pixel circuits is proportional to a duty ratio of one of the corresponding control signals, and an increment for the duty ratio of one of the corresponding control signals in the second frame is negatively correlated to a difference between a ratio of a preset time period to the time duration of the first frame and a ratio of the preset time period to the time duration of the second frame.

18 Claims, 13 Drawing Sheets

200

810

DISPLAY DEVICE AND DRIVING METHOD OF THE SAME

RELATED APPLICATION

The present application claims priority to Taiwan Application Serial Number 109130964, filed Sep. 9, 2020, which is incorporated herein by reference in its entirety.

BACKGROUND

Technical Field

The present disclosure relates to a display device and driving method of the same. More particularly, the present disclosure relates to a display device and driving method of the display device applicable of supporting variable refresh rate.

Description of Related Art

In order to prevent frame tearing, most of the display panels used in e-sports are supported with variable refresh rate, such that the display panels may dynamically adjust its frame rate according to an output frequency of an external graphic processor.

However, the processing time of each frame required for the external graphic processor unit may differ according to different complexity of the image detail, which causes the external graphic processor sending display signals to the display device at different time intervals. Therefore, there will be a blank (e.g., completely black screen) between each time interval, which further leads to screen flickering.

SUMMARY

In order to solve the problem mentioned above, one aspect of the present disclosure is to provide a display device including multiple pixel circuits, in which each of the pixel circuits include an emission unit, a first transistor, a second transistor, a control circuit and a pulse-width modulation circuit. The emission unit is configured to receive a first driving signal. A control terminal of the first transistor is configured to receive an emitting signal. The second transistor is coupled between a first node and a second node, and configured to receive a second driving signal through the second node, in which the first transistor, the second transistor and the emission unit are connected in series. The control circuit is coupled to a control terminal of the second transistor, and configured to control amplitude of a current provided by the second transistor to the emission unit. The pulse-width modulation circuit is configured to selectively provide a third driving signal to the control terminal of the second transistor according to a pulse signal, so as to determine a conduction time of the second transistor, in which if the first driving signal has a fixed voltage, the emitting signal having a first duty ratio repeatedly oscillates during a time duration of a first frame; if the first driving signal having a second duty ratio repeatedly oscillates during the time duration of the first frame, the emitting signal only provides a pulse in the first frame, in which the display device receives a first display data and receives a second display data after the time duration of the first frame has passed, and the first display data and the second display data respectively correspond to the first frame and a second frame, in which the pixel circuits are lit during a preset time interval in each frame of the display device, and an increment of the first duty ratio or the second duty ratio in the second frame is negatively correlated to a difference between a ratio of the preset time interval to the time duration of the first frame, and a ratio of the preset time interval to a time duration of the second frame.

Some aspects of the present disclosure provides a driving method applicable to a display device supporting variable refresh rate, in which the display device comprises a plurality of pixel circuits, and the method comprises: adjusting a plurality of control signals according to a first display data such that the plurality of pixel circuits generate a first frame; receiving a second display data generated after the first display data, in which the display device receives the first display data and receives the second display data after a time duration of the first frame has passed; and adjusting the plurality of control signals according to the time duration of the first frame such that the plurality of pixel circuits generate a second frame, in which the plurality of pixel circuits are lit for a preset time interval in each frame of the display device, and brightness of each of the plurality of pixel circuits is positively correlated to a duty ratio of a corresponding one of the plurality of control signals, and an increment of the duty ratio of the corresponding one of the plurality of control signals in the second frame is negatively correlated to a difference between a ratio of the preset time interval to the time duration of the first frame, and a ratio of the preset time interval to a time duration of the second frame.

As described above, the display device and the driving method in some embodiments of the present disclosure may reduce screen flickering problem causing by framerate variations of the display.

DETAILED DESCRIPTION

Figure 1:
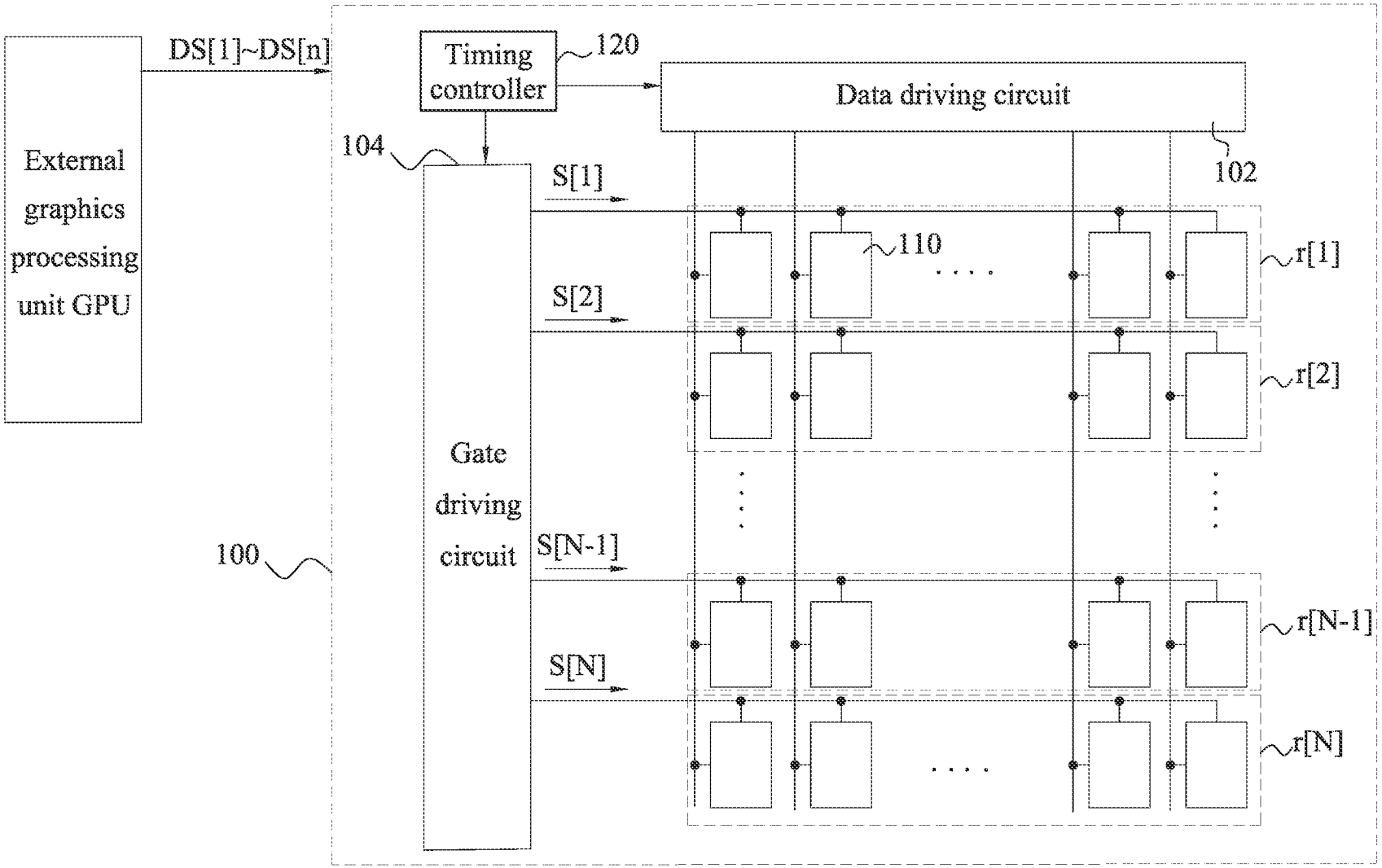
FIG. 1 is a simplified block diagram of a display device, in accordance with some embodiments of the present disclosure.

Reference will now be made in detail to the present embodiments of the disclosure, examples of which are illustrated in the accompanying drawings. Wherever possible, the same reference numbers are used in the drawings and the description to refer to the same or like parts.

All the terms used in this document generally have their ordinary meanings. The examples of using any terms discussed herein such as those defined in commonly used dictionaries are illustrative only, and should not limit the scope and meaning of the disclosure. Likewise, the present disclosure is not limited to some embodiments given in this document.

In this document, it may be understood that the terms "first," "second," and "third" are to describe the various elements, components, zones, levels and/or blocks. However, these elements, components, zones, levels and/or blocks should not be limited by these terms. These terms are used to distinguish one element, component, zone, level and/or block from another. For example, a first element, component, zone, level and/or block may be termed a second element, component, zone, level and/or block without departing from the scope of the present disclosure. As used herein, the term "and/or" includes any and all combinations of one or more of the associated listed items.

Furthermore, the term "coupled" or "connected" in this document may be used to indicate that two or more elements physically or electrically contact with each other, directly or indirectly. They may also be used to indicate that two or more elements cooperate or interact with each other.

FIG. 1 is a simplified block diagram of a display device 100, in accordance with some embodiments of the present disclosure. The display device 100 includes a data driving circuit 102, a gate driving circuit 104, a plurality of pixel circuits 110 and a timing controller 120, in which the pixel circuits 110 are arranged into a pixel matrix with multiple rows r[1]-r[N].

The timing controller 120 controls the gate driving circuit 104 to generate a plurality of gate signals S[1]-S[N] according to display signals DS[1]-DS[n] provided by an external graphics processing unit (GPU). The gate signals S[1]-S[N] are correspondingly provided to the multiple rows r[1]-r[N] of the pixel circuits 110 to drive the pixel matrix and update a display frame.

For instance, the gate driving circuit 104 provides the gate signals S[1] to the row r[1] of the pixel circuits 110 and provides the gate signals S[2] to the row r[2] of the pixel circuits 110, and so on. The gate driving circuit 104 provides the gate signal S[N] to the row r[N] of the pixel circuits 110, in which N is a positive integer. For the clarity of the drawings, other components of the display device 100 are not shown in FIG. 1.

Figure 2:
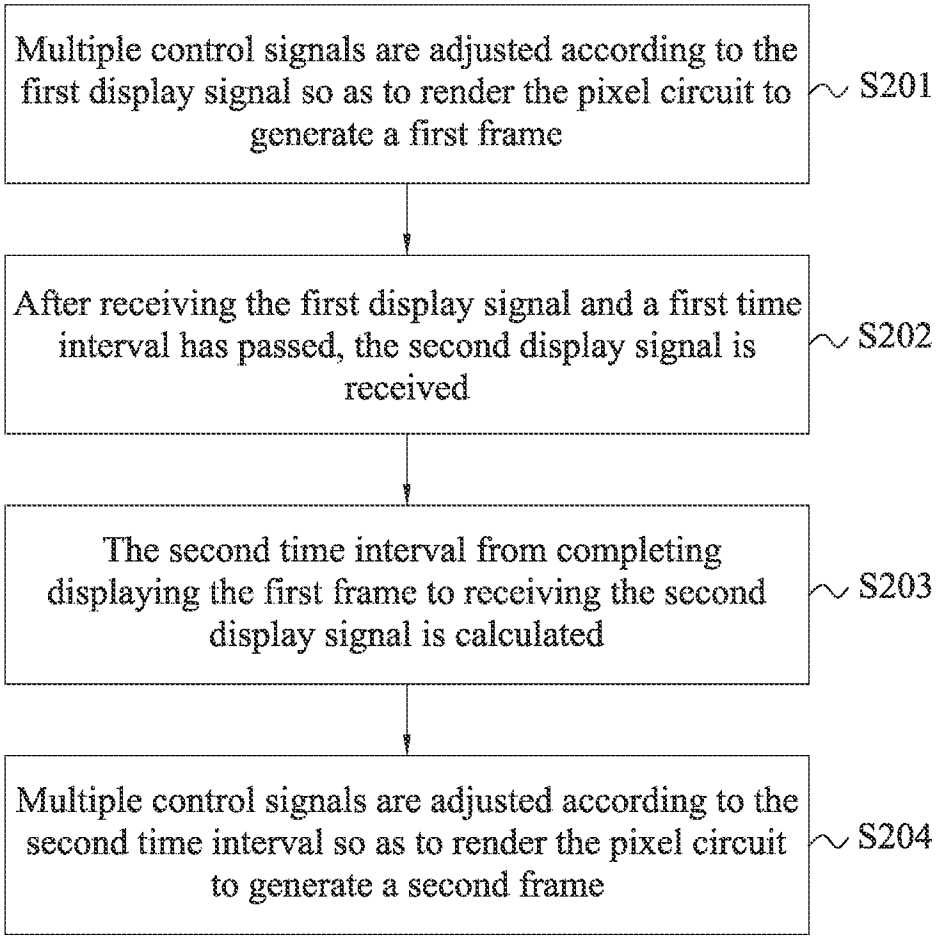
FIG. 2 is a flow chart of a driving method applicable to a display device, in accordance with some embodiments of the present disclosure.

FIG. 2 is a flow chart of a driving method 200 applicable to the display device 100, in accordance with some embodiments of the present disclosure. As shown in FIG. 2, the method 200 includes step S201, S202, S203 and S204. For the ease and clarity of illustration, the method 200 shown in FIG. 2 is illustrated with reference to FIG. 1 and FIG. 3 mentioned below, but is not limited thereto.

In step S201, the display device 100 adjust multiple control signals sent to the pixel matrix according to the display signal DS[1], such as adjusting the gate signals S[1]-S[N], operating voltage signal provided to the pixel circuits 110 (e.g, the first driving signal VSS and the second driving signal VDD mentioned in the following paragraphs) and/or data signals outputted by the data driving circuit 102, so as to render the pixel circuits 110 to generate a first frame. In some embodiments, the pixel circuits 110 begins a data writing stage and an emitting stage in response of the gate signals S[1]-S[N]. In some other embodiments, the data signals outputted by the data driving circuit 102 (e.g., the first data signal Sdata1 mentioned in the following paragraphs) are configured to designate gray levels (or brightness) of the pixel circuits 110.

Figure 3:
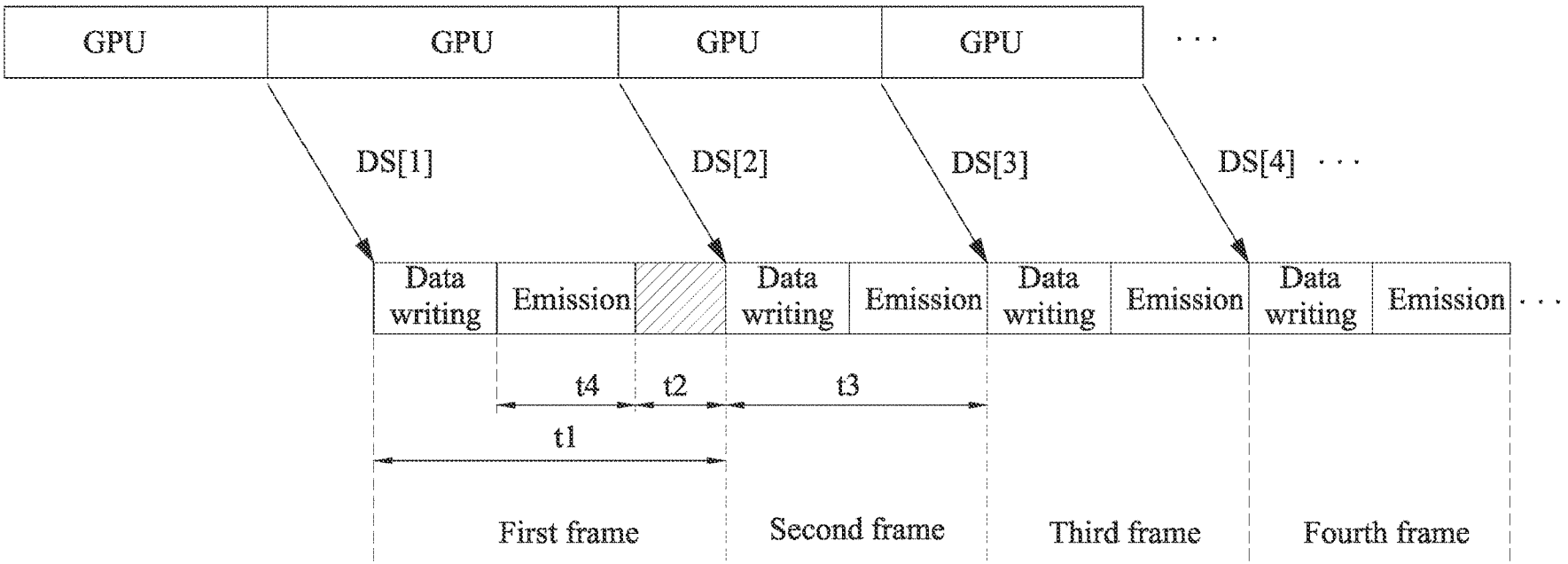
FIG. 3 is a schematic diagram illustrating a cooperative operation of a graphics processing unit and the display device.

Reference is now made to FIG. 3. FIG. 3 is a schematic diagram illustrating a cooperative operation of a graphics processing unit GPU and the display device 100. For instance, the processing time of each frame required for the external graphic processor unit GPU may differ, in which the graphic processor unit GPU may generate the display signal DS[1], the display signal DS[2], the display signal DS[3] and the display signal DS[4] at different time intervals.

In step S202, the display device 100 receives the display signal DS[2], in which the external graphic processor unit GPU generates the display signal DS[1] and generates the display signal DS[2] after a time duration of the first frame (hereinafter referred to as a first time interval t1) has passed. In some embodiments, the display signal DS[2] corresponds to a second frame with more complicated image details, such that the external graphic processor unit GPU needs to perform calculations at the longer first time interval t1 to generate the display signal DS[2]. Therefore, the display device 100 may display a blank frame (e.g., full black screen) in a second time interval t2 after completing displaying the first frame corresponding to the display signal DS[1], while waiting to receive the display signal DS[2].

Following step S202, in step S203, the display device 100 calculates a time interval of the blank frame (hereinafter referred to as the second time interval t2) from completing displaying the first frame to receiving the display signal DS[2]. For instance, total time duration of the data writing stage and the emitting stage of each frame is a third time interval t3, and a difference between the first time interval t1 and the third time interval t3 is the second time interval t2.

In some embodiments, the pixel circuits 110 are lit during the emitting stage of each frame of the display device 100, and the emitting stage of each frame has a same preset time interval t4.

In some embodiments, the display device 100 completes displaying the first frame by disabling each of the pixel circuits 110 after the emitting stage of the first frame is over.

In some other embodiments, the display device 100 completes displaying the first frame by sequentially disabling the pixel circuits 110. For instance, the display device 100 may complete displaying the first frame by disabling row r[1] of the pixel circuits 110, and sequentially disabling row r[2] and row r[3] of the pixel circuits 110 until row r[N] of the pixel circuits 110 is also disabled.

Following step S203, in step S204, the display device 100 adjusts the multiple control signals provided to the pixel matrix according to the display signal DS[2] and the second time interval t2, For instance, the display device 100 may adjust the gate signals S[1]-S[N], the operating voltage signals and/or the data signals outputted by the data driving circuit 102, so as to render the pixel circuits 110 to generate the second frame. In some embodiments, the gate signals S[1]-S[N] may be repeatedly oscillating signals with a duty ratio that can be adjusted according to a proportion of the emitting stage in the frame. Brightness of each of the pixel circuits 110 may be positively correlated to the duty ratio of corresponding one of the gate signals S[1]-S[N]. The following paragraphs will further illustrate with subsequent drawings.

In some embodiments, an increment of the duty ratio of corresponding one of the gate signals S[1]-S[N] in the second frame is negatively correlated to a difference between a ratio of the preset time interval t4 to the time duration of the first frame, and a ratio of the preset time interval t4 to a time duration of the second frame.

For instance, as shown in FIG. 3, a ratio r1 of the emitting stage of the first frame to the time duration of the first frame can be expressed by the following formula 1.

$$r1=t4/t1 \quad \text{(formula 1)}$$

For another example, a ratio r2 of the emitting stage of the second frame to the time duration of the second frame can be expressed by the following formula 2, in which the time duration of the second frame is represented as the third time interval t3.

$$r2=t4/t3 \quad \text{(formula 2)}$$

As shown in FIG. 3, the ratio r1 is smaller than the ratio r2. Therefore, the display device 100 may set the increment of the duty ratio of corresponding one of the gate signals S[1]-S[N] in the second frame to be positively correlated to the difference of the ratio r1 and the ratio r2, such that the brightness attenuation of the display device 100 causing by the second time interval t2 may be compensated.

In other words, the increment of the duty ratio of corresponding one of the gate signals S[1]-S[N] in the second frame is positively correlated to a ratio of the second time interval t2 to the first time interval t1, and brightness of each of the pixel circuits 110 in the second frame is also positively correlated to the ratio of the second time interval t2 to the first time interval t1. Therefore, the users may experience that the second frame and the first frame have substantially the same equivalent brightness. Thus, the problem regarding screen flickering due to variable refresh rate of the display device 100 can be solved.

Figure 4:
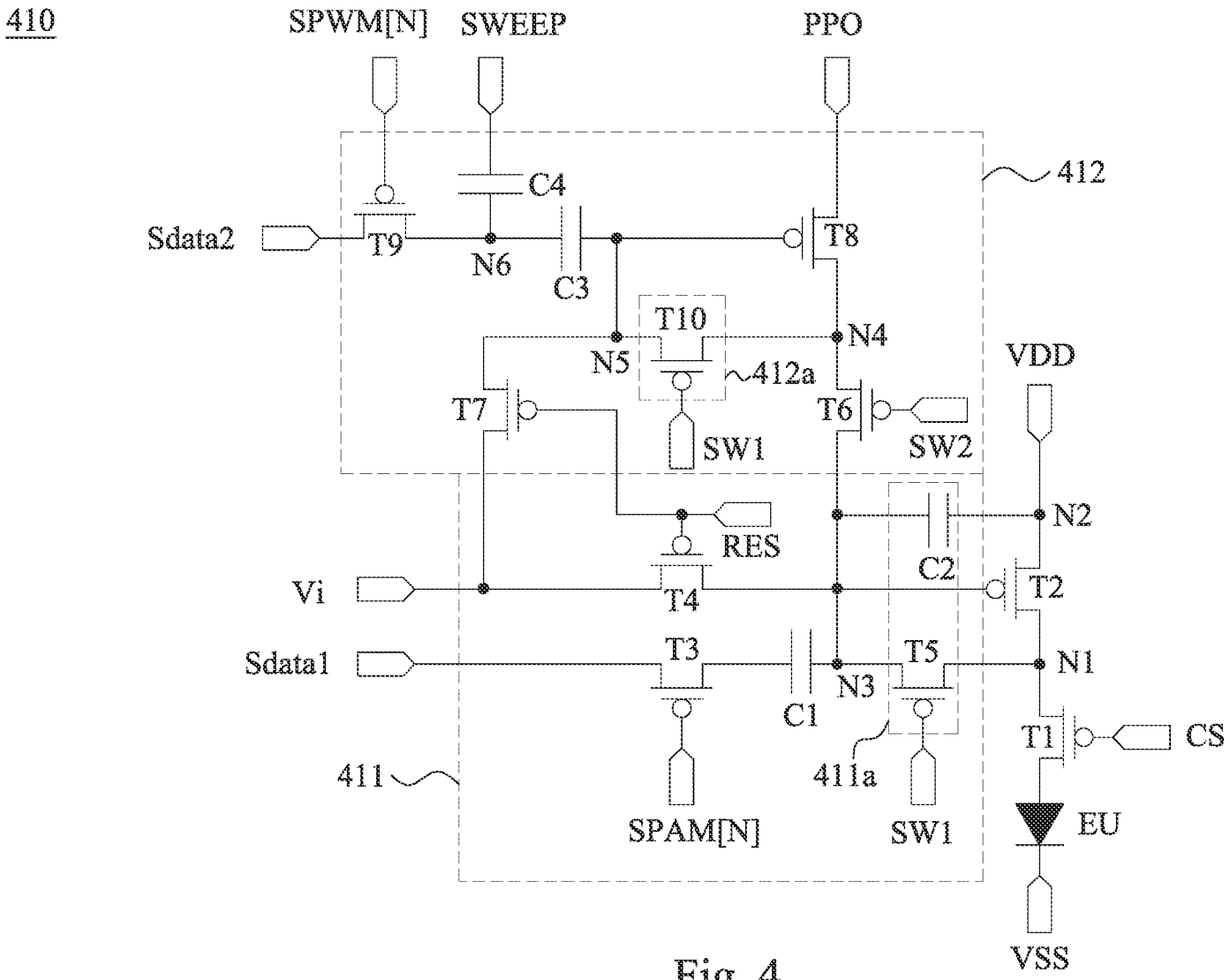
FIG. 4 is a schematic diagram of a pixel circuit, in accordance with some embodiments of the present disclosure.

FIG. 4 is a schematic diagram of a pixel circuit 410, in accordance with some embodiments of the present disclosure. The pixel circuits 110 in FIG. 1 may be implemented by the pixel circuit 410, and the pixel circuit 410 includes an emission unit EU, a first transistor T1, a second transistor T2, a control circuit 411 and a pulse-width modulation (PWM) circuit 412. In practice, the emission unit EU may be implemented by a micro light emitting diode (Mirco-LED) or an organic light emitting diode (OLED).

In some embodiments, the emission unit EU is configured to receive a first driving signal VSS. A control terminal of the first transistor T1 is configured to receive an emitting signal CS. The second transistor T2 is coupled between a first node N1 and a second node N2. The second transistor T2 is configured to receive a second driving signal VDD through the second node N2. The first transistor T1, the second transistor T2 and the emission unit EU are connected in series. In the embodiments of FIG. 4, the first transistor T1 is coupled between the emission unit EU and the first node N1. The control circuit 412 is coupled to a control terminal of the second transistor T2. The control circuit 412 is configured to control amplitude of a current provided by the second transistor T2 to the emission unit EU. The pulse-width modulation circuit 412 is configured to selectively provide a third driving signal PPO to the control terminal of the second transistor T2 according to a pulse signal SWEEP so as to determine a conduction time of the second transistor T2. The operations of the control circuit 411 and the pulse-width modulation circuit 412 will be described in further detail in the following paragraphs.

In some embodiments where all of the pixel circuits 110 of the display device 100 simultaneously emit light, the emitting signal CS may correspond to all of the gate signals S[1]-S[N] in FIG. 1. In some embodiments where the pixel circuits 110 of the display device 100 sequentially emit light, the emitting signal CS may correspond to one of the gate signals S[1]-S[N] in FIG. 1. In other words, the display device 100 may adjust a duty ratio of the emitting signal CS in step S204, such that an increment of the duty ratio of the emitting signal CS in the second frame is negatively correlated to a difference between the ratio of the emitting stage to the time duration of the first frame, and a ratio of the emitting stage to the time duration of the second frame, and the equivalent brightness provided by the pixel circuit 410 is positively correlated to the duty ratio of the emitting signal CS.

In some embodiments, the control circuit 411 includes a third transistor T3, a first capacitor C1, a fourth transistor T4 and a first compensating circuit 411*a*. Each of the third transistor T3 and the fourth transistor T4 includes a first terminal, a second terminal and a control terminal. The first terminal of the third transistor T3 is configured to receive the first data signal Sdata1, the control terminal of the third transistor T3 is configured to receive the first write signal SPAM[N]. A first terminal of the first capacitor C1 is coupled to the second terminal of the third transistor T3, and a second terminal of the first capacitor C1 is coupled to a third node N3. The second terminal of the fourth transistor T4 and the control terminal of the second transistor T2 are coupled to the third node N3. The first compensating circuit 411*a* is coupled to the control terminal of the second transistor T2, the first node N1 and the second node N2. The first compensating circuit 411*a* is configured to detect a threshold voltage of the second transistor T2.

In some embodiments, the first compensating circuit 411*a* includes a fifth transistor T5 and a second capacitor C2. The fifth transistor T5 includes a first terminal, a second terminal and a control terminal. The first terminal of the fifth transistor T5 is coupled to the first node N1, the second terminal of the fifth transistor T5 is coupled to the third node N3, and the control terminal of the fifth transistor T5 is configured to receive a first switching signal SW1. The second capacitor C2 is coupled between the second node N2 and the third node N3.

In some embodiments, the pulse-width modulation circuit 412 includes a sixth transistor T6, a seventh transistor T7, an eighth transistor T8, a ninth transistor T9, a second compensating circuit 412*a*, a third capacitor C3 and a fourth capacitor C4. Each of the sixth transistor T6, the seventh transistor T7, the eighth transistor T8 and the ninth transistor T9 includes a first terminal, a second terminal and a control terminal. The second terminal of the sixth transistor T6 is coupled to the control terminal of the second transistor T2 through the third node N3. The first terminal of the sixth transistor T6 is coupled to the fourth node N4. The second terminal of the seventh transistor T7 and the first terminal of the fourth transistor T4 are configured to receive a reference voltage Vi together. The control terminal of the seventh transistor T7 and the control terminal of the fourth transistor T4 are configured to receive a reset signal RES. The first terminal of the eighth transistor T8 is configured to receive a third driving signal PPO. The second terminal of the eighth transistor T8 is coupled to the fourth node N4. The control terminal of the eighth transistor T8 is coupled to a fifth node N5. The second compensating circuit 412*a* is coupled to the fourth node N4, the fifth node N5 and the first terminal of the seventh transistor T7, and the second compensating circuit 412*a* is configured to detect a threshold voltage of the eighth transistor T8.

The third capacitor C3 includes a first terminal and a second terminal, in which the first terminal of the third capacitor C3 is coupled to a sixth node N6, and the second terminal of the third capacitor C3 is coupled to the fifth node N5. The fourth capacitor C4 includes a first terminal and a second terminal, in which the first terminal of the fourth capacitor C4 is configured to receive the pulse signal SWEEP, and the second terminal of the fourth capacitor C4 is coupled to the sixth node N6. The first terminal of the ninth transistor T9 is configured to receive a second data signal Sdata2, the second terminal of the ninth transistor T9 is coupled to the sixth node N6, and the control terminal of the ninth transistor T9 is configured to receive a second write signal SPWM[N].

In some embodiments, the second compensating circuit 412*a* includes a tenth transistor T10. The tenth transistor T10 is coupled between the fourth node N4 and the fifth node N5, in which a control terminal of the tenth transistor T10 is configured to receive the first switching signal SW1.

Figure 5A:
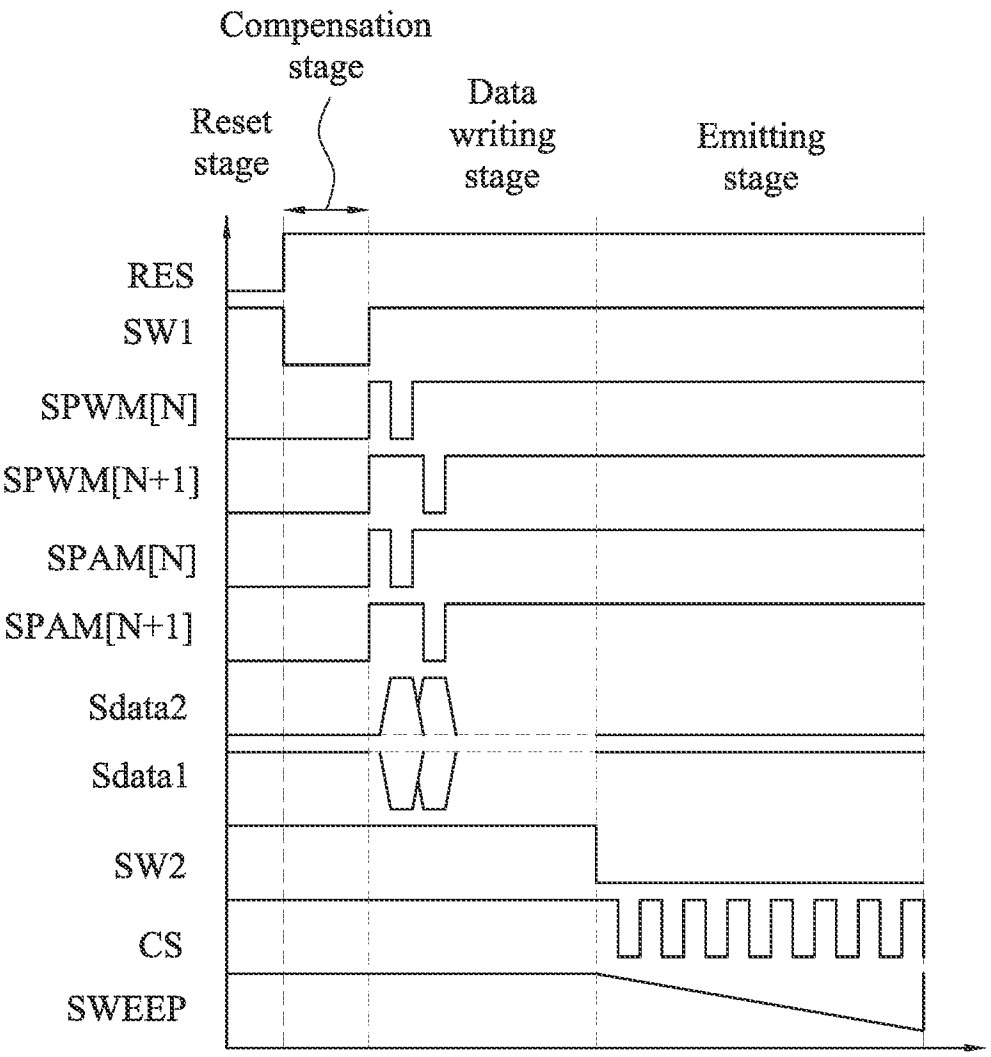
FIGS. 5A-5C are schematic diagrams of signal waveforms in the pixel circuit, in accordance with some embodiments of the present disclosure.
Figure 5B:
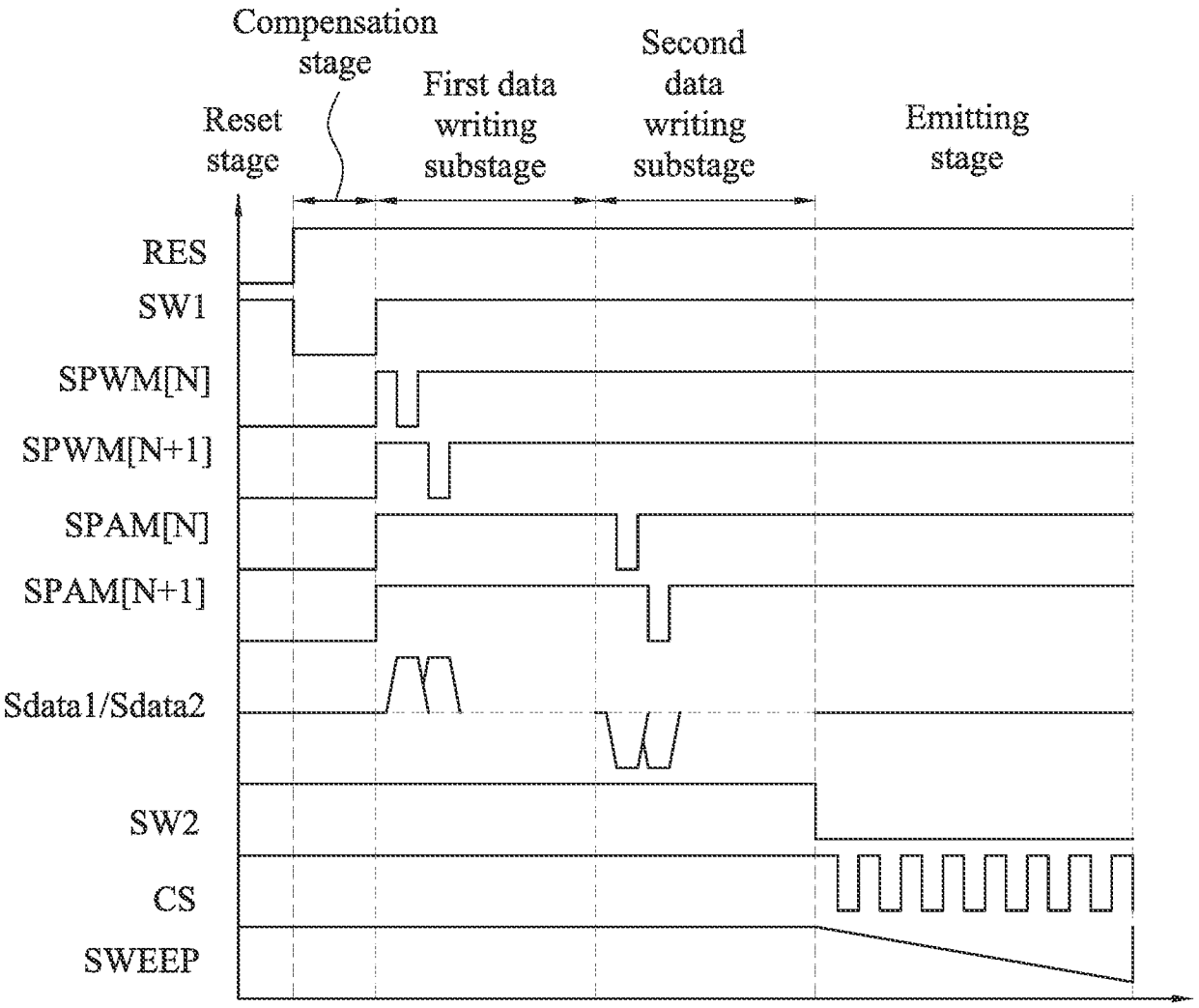
Figure 5C:
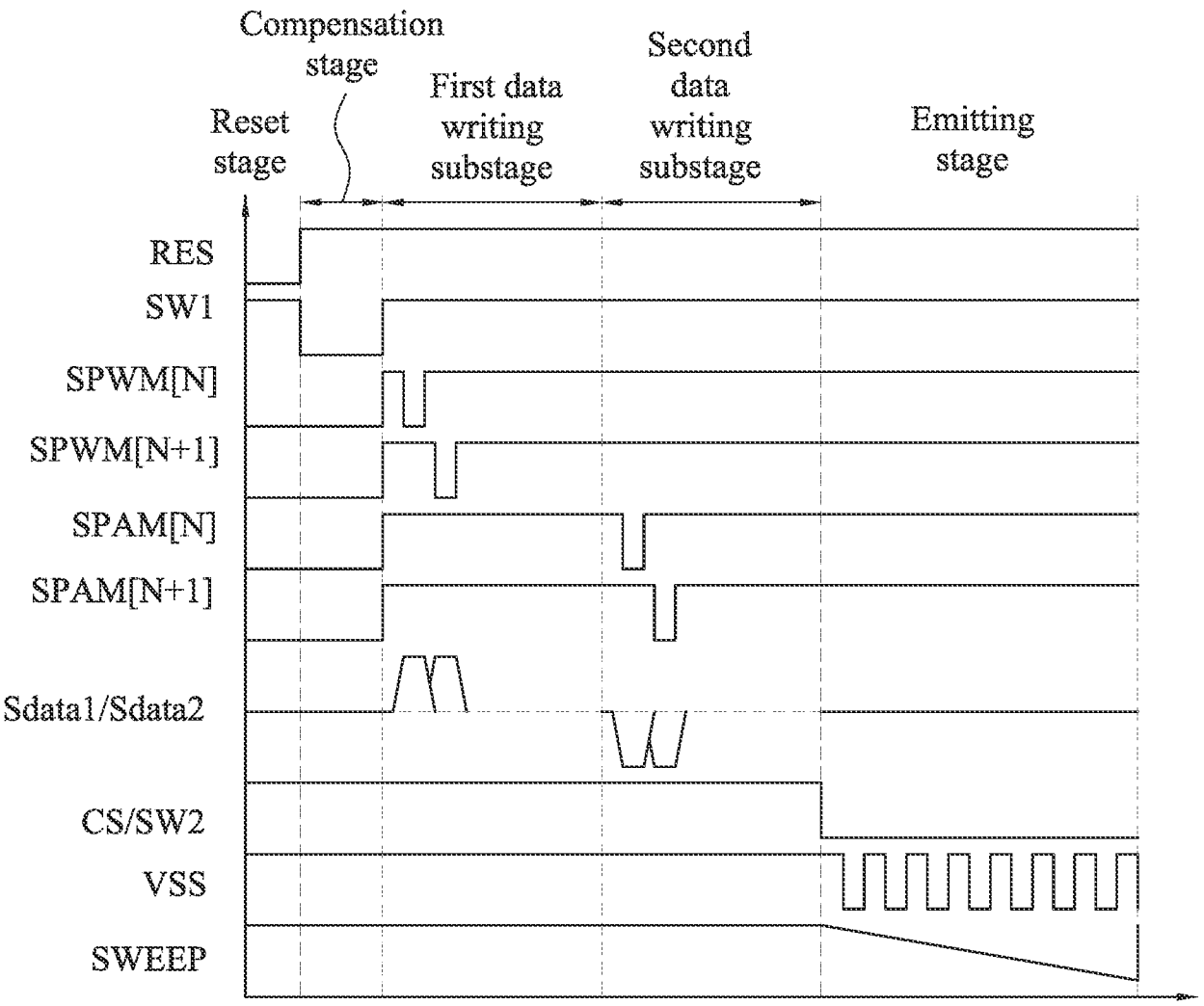

FIGS. 5A-5C are schematic diagrams of signal waveforms in the pixel circuit 410, in accordance with some embodiments of the present disclosure. In some embodiments, the first data signal Sdata1 and the second data signal Sdata2 are generated from the data driving circuit 102, the emitting signal CS is generated from the gate driving circuit 104. In some other embodiments, the first switching signal SW1, the second switching signal SW2, the first write signal SPAM[N] and the second write signal SPWM[N] may be generated from the gate driving circuit 104 or other one or multiple gate driving circuits.

FIGS. 6A-6D are schematic diagrams of operations for an equivalent circuit of the pixel circuit 410, in accordance with some embodiments of the present disclosure. The operations of the pixel circuit 410 in FIG. 4 will be described in the following paragraphs by referring to FIG. 5A and FIGS. 6A-6D.

Figure 6A:
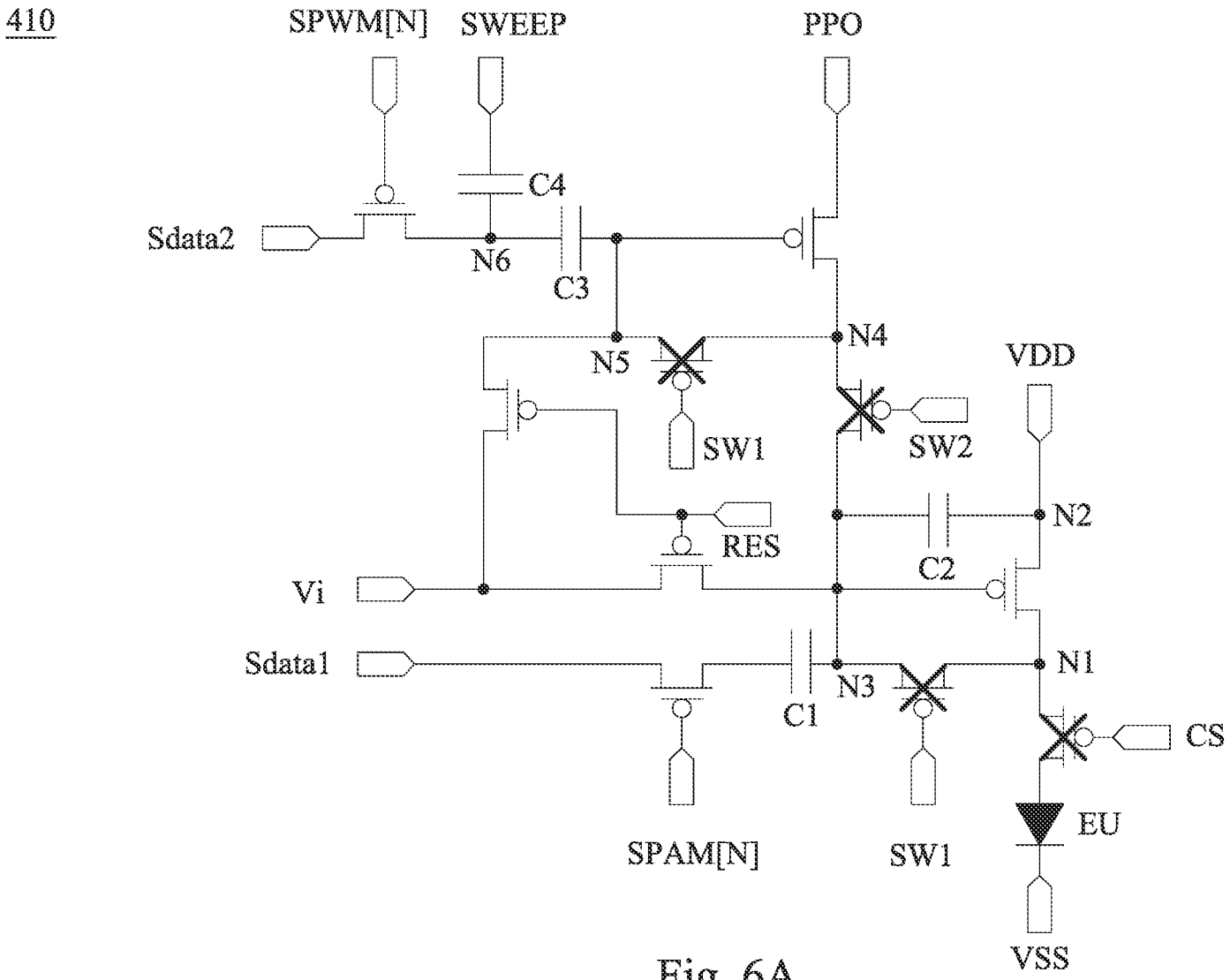
FIGS. 6A-6D are schematic diagrams of operations for an equivalent circuit of the pixel circuit, in accordance with some embodiments of the present disclosure.

As shown in FIG. 6A, during a reset stage, the third transistor T3, the fourth transistor T4, the seventh transistor T7 and the ninth transistor T9 are conducted. Therefore, the node N3 and the node N4 are set to the reference voltage Vi.

Figure 6B:
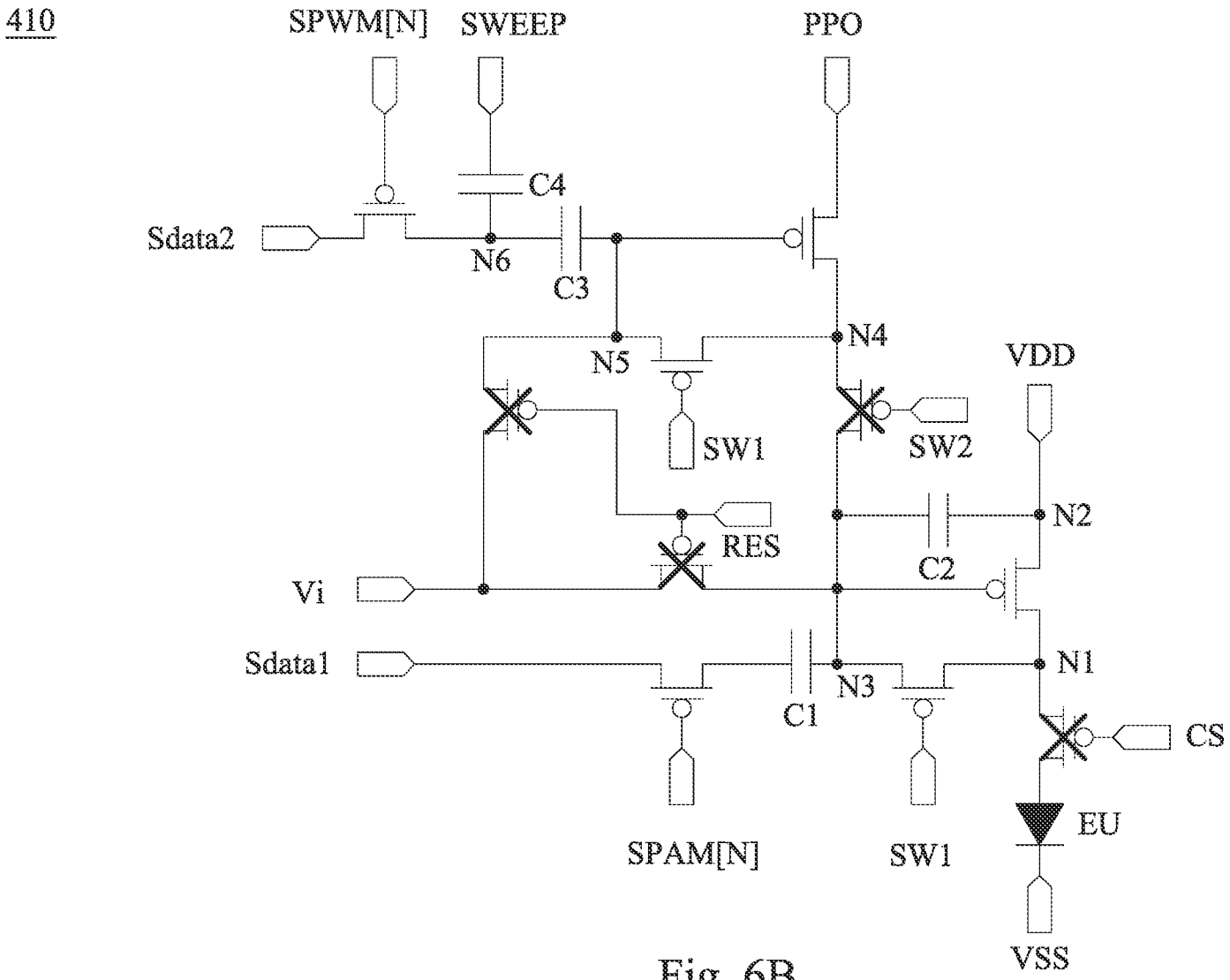

As shown in FIG. 6B, during a compensation stage, the first transistor T1, the fourth transistor T4, the sixth transistor T6 and the seventh transistor T7 are turned off. The fifth transistor T5 and the tenth transistor T10 are conducted. Therefore, the threshold voltage of the second transistor T2 is recoded in the third node N3, and the threshold voltage of the eighth transistor T8 is recoded in the fifth node N5.

Figure 6C:
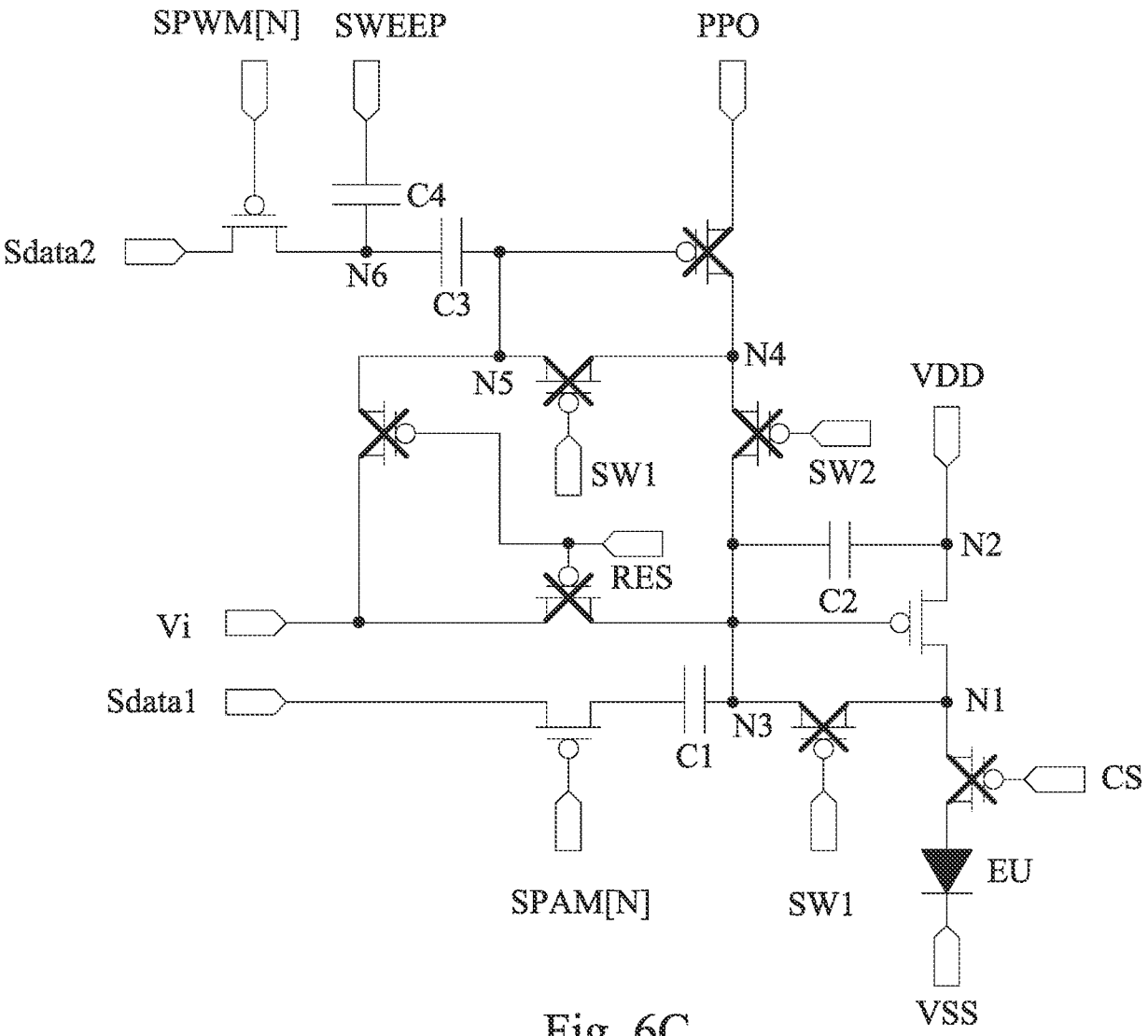

As shown in FIG. 6C, during the data writing stage, the fifth transistor T5 and the tenth transistor T10 are turned off. When the third transistor T3 and the ninth transistor T9 are conducted, the first data signal Sdata1 is transmitted to the third node N3 through capacitive coupling, such that the second transistor T2 is conducted. On the other hand, the second data signal Sdata2 is transmitted to the fifth node N5 through capacitive coupling, such that the eighth transistor T8 is turned off.

In some other embodiments, as shown in FIG. 5B, the first data signal Sdata1 and the second data signal Sdata2 may be the same signal. In such way, the data writing stage may be divided into a first data writing substage and a second data writing substage. In the first data writing substage, the node N5 is set to an appropriate voltage to turn off the eighth transistor T8. In the second data writing substage, the node N3 is set to an appropriate voltage to conduct the second transistor T2.

Figure 6D:
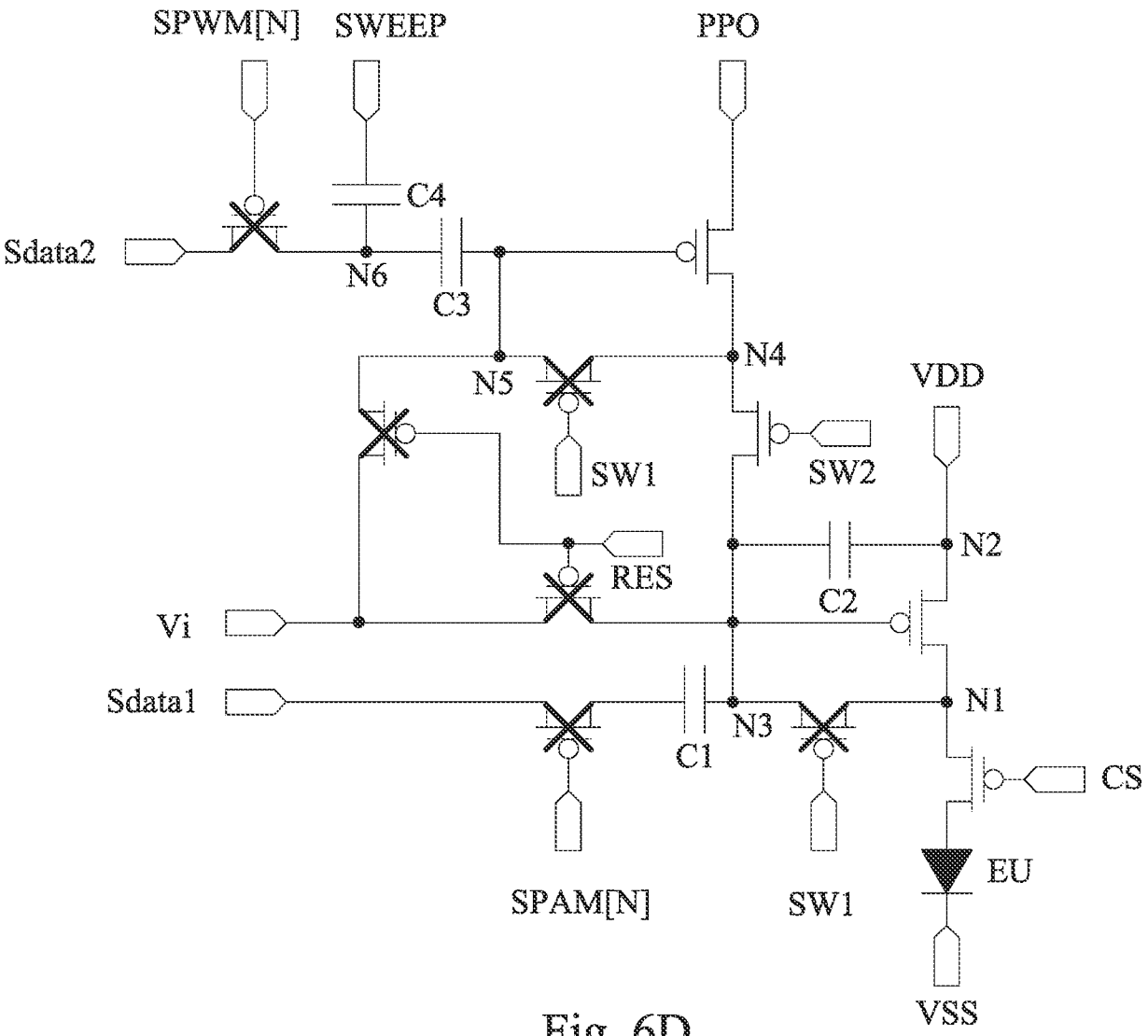

Reference is now made to FIG. 5A and FIG. 6D, during the emitting stage, the third transistor T3 and the ninth transistor T9 are turned off. The sixth transistor T6 is conducted. The first driving signal VDD has a fixed voltage level, and the emitting signal CS repeatedly oscillates during this stage. As mentioned above, the duty ratio of the emitting signal CS is correlated to the proportion of the emitting stage in the previous frame. For the sake of brevity, those descriptions will not be repeated again. A duty ratio of the current provided to the emission unit EU is positively correlated to the duty ratio of the emitting signal CS, so the equivalent brightness provided by the emission unit EU is positively correlated to the duty ratio of the emitting signal CS. In this way, the pulse signal SWEEP provides a ramp pulse such that the voltage of the node N5 decreases accordingly, and the eighth transistor T8 may be re-conducted at the appropriate time. Through the sixth transistor T6 and the conducted eighth transistor T8, the third driving signal PPO may be transmitted to the third node N3 to turn off the second transistor T2.

It should be noted that the voltage set to the node N5 during the data writing stage may determine the timing of the eighth transistor T8 to be re-conducted. For instance, if a higher voltage is set to the node N5 during the data writing stage, it may take more time to re-conduct the eighth transistor T8, and vice versa. Therefore, the pulse-width modulation circuit 412 may determine time duration of the second transistor T2 being conducted in the emitting stage.

Based on above, the equivalent brightness of a frame provided by the pixel circuit 410 may be determined by three factors: amplitude of the current provided by the second transistor T2; time duration of the second transistor T2 being conducted; and the duty ratio of the emitting signal CS. When the pixel circuit 410 is applied to the display device 100 and the display device 100 performs the driving method 200, the display device 100 may adjust the duty ratio of the emitting signal CS in step S204. Therefore, the display device 100 may adaptively control the pixel circuit 410 to provide corresponding equivalent brightness according to framerate variations, such as providing higher equivalent brightness when the framerate is low and vice versa, so as to prevent users from experiencing screen flickering in variable refresh rate mode.

In some other embodiments, the control signals adjusted by the display device 100 in the step S204 of the driving method 200 include the first driving signal VSS provided to the pixel circuit 410. Reference is now made to FIG. 4 and FIG. 5C. The first driving signal VSS may repeatedly oscillate during the emitting stage, in which the duty ratio of the first driving signal VSS is adjusted as described in the step S204 aforementioned. For the sake of brevity, those descriptions will not be repeated here. Moreover, the emitting signal CS only provides a single pulse during the emitting stage. In other words, the first transistor T1 remains being conducted during the emitting stage. Therefore, the emission unit EU may be intermittently conducted corresponding to the duty ratio of the first driving signal VSS during the emitting stage, such that the emission unit EU may adaptively provide corresponding equivalent brightness according to framerate variations of the display device 100 to prevent screen flickering.

Based on multiple embodiments mentioned above, if the first driving signal VSS has a fixed voltage, the emitting signal CS repeatedly oscillates during the time duration of the first frame; and if the first driving signal VSS repeatedly oscillates during the time duration of the first frame, then the emitting signal CS only provides a pulse in the first frame.

Figure 7:
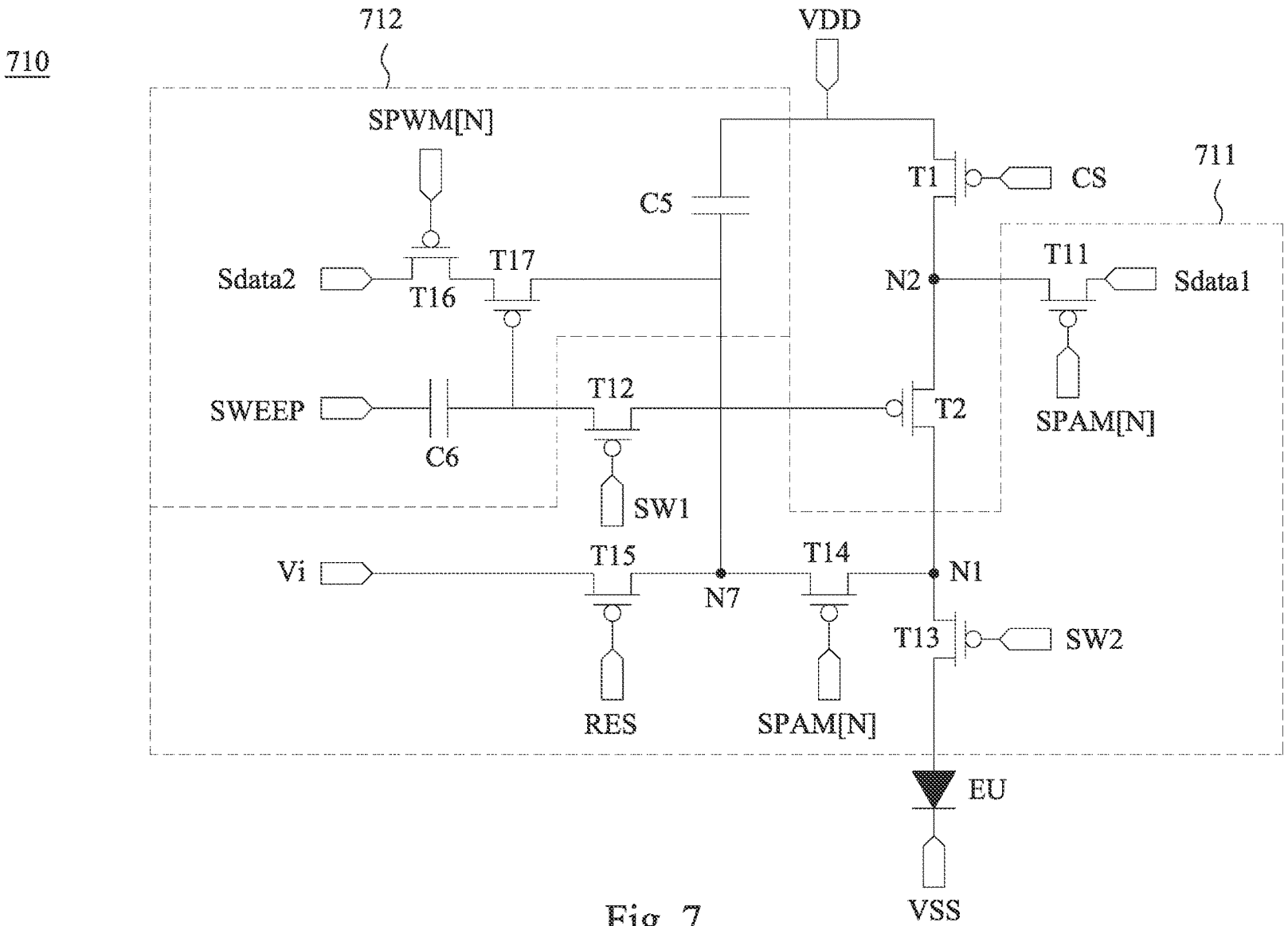
FIG. 7 is a schematic diagram of a pixel circuit, in accordance with some other embodiments of the present disclosure.

FIG. 7 is a schematic diagram of a pixel circuit 710, in accordance with some other embodiments of the present disclosure. The pixel circuits 110 in FIG. 1 may be also implemented by the pixel circuit 710. As shown in FIG. 7, the pixel circuit 710 includes the emission unit EU, the first transistor T1, the second transistor T2, a control circuit 711 and a pulse-width modulation circuit 712. In this embodiment, the first terminal of the first transistor T1 is configured to receive the second driving signal VDD, the second terminal of the first transistor T1 is coupled to the second transistor T2, and the control terminal of the first transistor T1 is configured to receive the emitting signal CS. The operations of the control circuit 711 and the pulse-width modulation circuit 712 are similar to the operations of the control circuit 411 and the pulse-width modulation circuit 412 in FIG. 4.

As shown in FIG. 7, the control circuit 711 includes an eleventh transistor T11, a twelfth transistor T12, a thirteenth transistor T13, a fourteenth transistor T14 and a fifteenth transistor T15. The eleventh transistor T11 includes a first terminal, a second terminal and a control terminal. The first terminal of the eleventh transistor T11 is coupled to the second node N2, the second terminal of the eleventh transistor T11 is configured to receive the first data signal Sdata1, and the control terminal of the eleventh transistor T11 is configured to receive the first write signal SPAM[N]. The twelfth transistor T12 is coupled between the control terminal of the second transistor T2 and the pulse-width modulation circuit 712. The control terminal of the twelfth transistor T12 is configured to receive the first switching signal SW1. The thirteenth transistor T13 is coupled between the emission unit EU and the first node N1. The control terminal of the thirteenth transistor T13 is configured to receive the second switching signal SW2. The fourteenth transistor T14 includes a first terminal, a second terminal and a control terminal. The second terminal of the fourteenth transistor T14 is coupled to the first node N1, and the control terminal of the fourteenth transistor T14 is configured to receive the first write signal SPAM[N]. The fifteenth transistor T15 includes a first terminal, a second terminal and a control terminal. The second terminal of the fifteenth transistor T15 and the first terminal of the fourteenth transistor T14 are coupled to a seventh node N7, and the control terminal of the fifteenth transistor T15 is configured to receive the reset signal RES.

The pulse-width modulation circuit 712 includes a fifth capacitor C5, a sixteenth transistor T16, a seventeenth transistor T17 and a sixth capacitor C6. A first terminal of the fifth capacitor C5 is configured to receive the second driving signal VDD, and a second terminal of the fifth capacitor C5 is coupled to the seventh node N7. The sixteenth transistor T16 includes a first terminal, a second terminal and a control terminal. The first terminal of the sixteenth transistor T16 is configured to receive the second data signal Sdata2, and the control terminal of the sixteenth transistor T16 is configured to receive the second write signal SPWM[N]. The seventeenth transistor T17 is coupled between the sixteenth transistor T16 and the seventh node N7. A first terminal of the sixth capacitor C6 is configured to receive the pulse signal SWEEP, and a second terminal of the sixth capacitor C6 is coupled to a control terminal of the seventeenth transistor T17.

In this embodiment, connections and operations of the first transistor T1, the second transistor T2, the control circuit 711 and the pulse-width modulation circuit 712 are similar to corresponding elements or functional blocks in FIG. 4. In other words, the duty ratio of the emitting signal CS or the first driving signal VSS may be adjusted as described in step S204 aforementioned. For the sake of brevity, those descriptions will not be repeated here.

Figure 8:
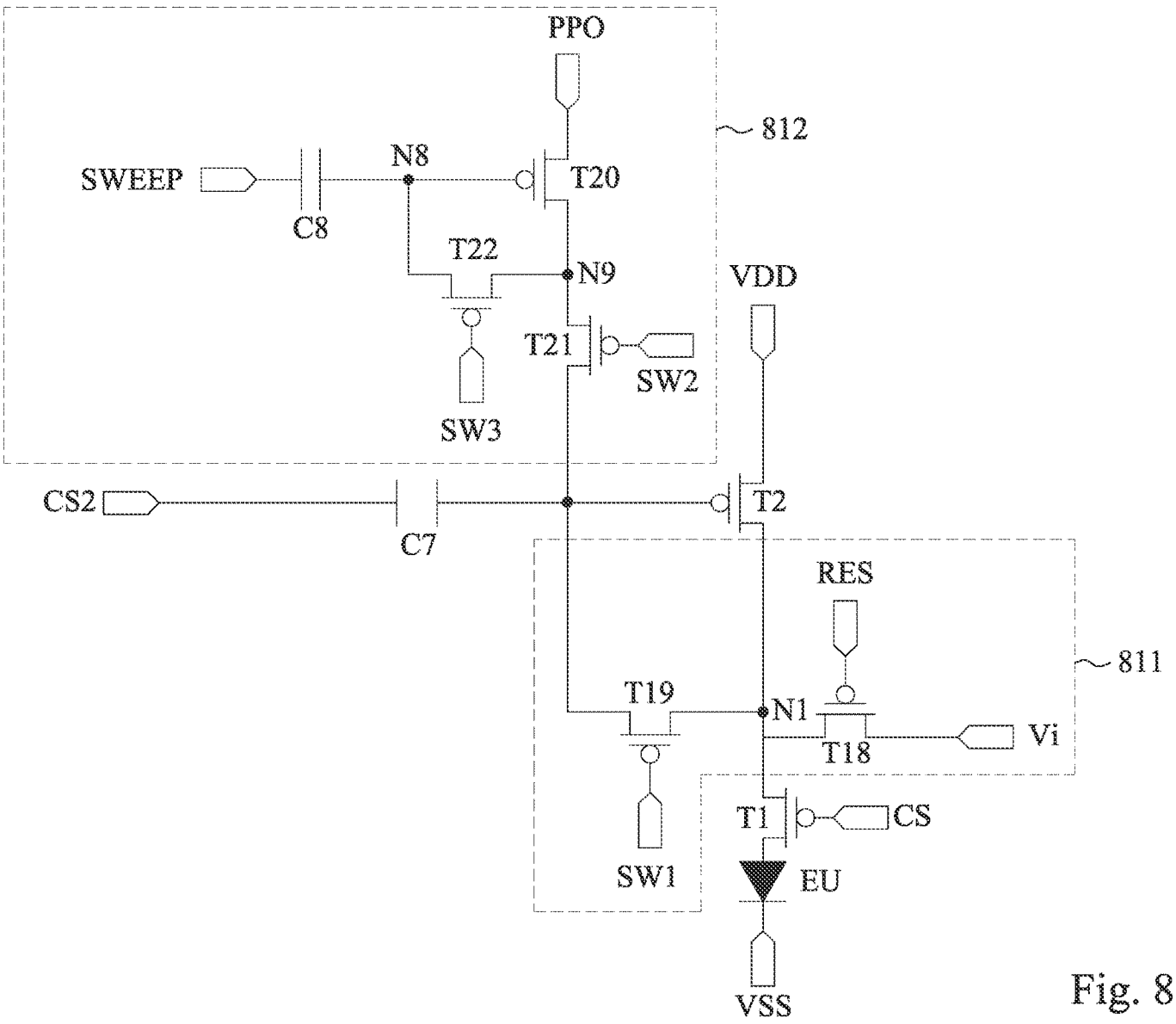
FIG. 8 is a schematic diagram of a pixel circuit, in accordance with some other embodiments of the present disclosure.

FIG. 8 is a schematic diagram of a pixel circuit 810, in accordance with some other embodiments of the present disclosure. The pixel circuits 110 in FIG. 1 may be also implemented by the pixel circuit 810. The pixel circuit 810 includes the emission unit EU, the first transistor T1, the second transistor T2, a seventh capacitor C7, a control circuit 811 and a pulse-width modulation circuit 812. In some embodiments, the control circuit 811 may be replaced by other equivalent circuits that can control amplitude of the current provided to the emission unit EU through the second transistor T2. The pulse-width modulation circuit 812 may be replaced by other equivalent circuits that can determine the time duration of the second transistor T2 being conducted.

As shown in FIG. 8, the seventh capacitor C7 includes a first terminal and a second terminal. The first terminal of the seventh capacitor C7 is coupled to the control terminal of the second transistor T2, and the second terminal of the seventh capacitor C7 is configured to receive a fourth driving signal CS2 which repeatedly oscillates in the frame.

The control circuit 811 includes an eighteenth transistor T18 and a nineteenth transistor T19. The eighteenth transistor T18 includes a first terminal, a second terminal and a control terminal. The first terminal of the eighteenth transistor T18 is coupled to the first node N1, and the control terminal of the eighteenth transistor is configured to receive the reset signal RES. The nineteenth transistor T19 includes a first terminal, a second terminal and a control terminal. The first terminal of the nineteenth T19 transistor is coupled to the first node N1, the second terminal of the nineteenth transistor T19 is coupled to the control terminal of the second transistor T2, and the control terminal of the nineteenth transistor T19 is configured to receive the first switching signal SW1.

The pulse-width modulation circuit 812 includes a twentieth transistor T20, a twenty-first transistor T21, a twenty-second transistor T22 and an eighth capacitor C8. The twentieth transistor T20 includes a first terminal, a second terminal and a control terminal. The first terminal of the twentieth transistor T20 is configured to receive the third driving signal PPO, and the control terminal of the twentieth transistor T20 is coupled to an eighth node N8. The twenty-first transistor T21 includes a first terminal, a second terminal and a control terminal. The first terminal of the twenty-first transistor T21 is coupled to a ninth node N9, and the second terminal of the twenty-first transistor T21 is coupled to the second terminal of the seventh capacitor C7. The twenty-second transistor T22 is coupled between the eighth node N8 and the ninth node N9. A control terminal of the twenty-second transistor T22 is configured to receive the third switching signal SW3. A first terminal of the eighth capacitor C8 is configured to receive the pulse signal SWEEP, and a second terminal of the eighth capacitor C8 is coupled to the eighth node N8.

In this embodiment, the control signals adjusted by the display device 100 in the step S204 of the driving method 200 include the fourth driving signal CS2 provided to the pixel circuit 810. In other words, the fourth driving signal CS2 may be one of the gate signals S[1]-S[N] in FIG. 1. Therefore, the fourth driving signal CS2 may repeatedly oscillate during the emitting stage, and adjustments of the duty ratio of the fourth driving signal CS2 are as described in step S204 aforementioned. For the sake of brevity, those descriptions will not be repeated here. Furthermore, the first driving signal VSS received by the pixel circuit 810 has a fixed voltage, and the emitting signal CS only provides a pulse during the emitting stage. When the fourth driving signal CS2 repeatedly oscillates during the emitting stage, the pulse signal SWEEP provides a ramp pulse.

The control terminal of the second transistor T2 receives the fourth driving signal CS2 through the seventh capacitor C7, so the second transistor T2 may be intermittently conducted corresponding to the duty ratio of the fourth driving signal CS2 during the emitting stage, such that the corresponding equivalent brightness may be provided adaptively according to framerate variations of the display device 100 to prevent screen flickering.

In some embodiments, the display device 100 may perform the driving method 200 multiple times to adaptively adjust equivalent brightness of each frame.

While the disclosure has been described by way of example(s) and in terms of the preferred embodiment(s), it is to be understood that the disclosure is not limited thereto. Those skilled in the art may make various changes, substitutions, and alterations herein without departing from the spirit and scope of the present disclosure. In view of the foregoing, it is intended that the present invention cover modifications and variations of this invention provided they fall within the scope of the following claims.

What is claimed is:

1. A display device comprising a plurality of pixel circuits, wherein each of the plurality of pixel circuits comprises:

an emission unit configured to receive a first driving signal;

a first transistor, wherein a control terminal of the first transistor is configured to receive an emitting signal;

a second transistor coupled between a first node and a second node, configured to receive a second driving signal through the second node, wherein the first transistor, the second transistor and the emission unit are connected in series;

a control circuit coupled to a control terminal of the second transistor, configured to control amplitude of a current provided by the second transistor to the emission unit; and a pulse-width modulation circuit configured to selectively provide a third driving signal to the control terminal of the second transistor according to a pulse signal so as to determine a conduction time of the second transistor; wherein if the first driving signal has a fixed voltage, the emitting signal having a first duty ratio repeatedly oscillates during a time duration of a first frame;

if the first driving signal having a second duty ratio repeatedly oscillates during the time duration of the first frame, the emitting signal only provides a pulse in the first frame, wherein the display device receives a first display data and receives a second display data after the time duration of the first frame has passed, and the first display data and the second display data respectively correspond to the first frame and a second frame, wherein the plurality of pixel circuits are lit during a preset time interval in each frame of the display device, and an increment of the first duty ratio or the second duty ratio in the second frame is negatively correlated to a difference between a ratio of the preset time interval to the time duration of the first frame, and a ratio of the preset time interval to a time duration of the second frame.

2. The display device of claim 1, wherein the control circuit comprises:

a third transistor, wherein a first terminal of the third transistor is configured to receive a first data signal, and a control terminal of the third transistor is configured to receive a first write signal;

a first capacitor coupled between a second terminal of the third transistor and a third node;

a fourth transistor comprising a first terminal, a second terminal and a control terminal, wherein the second terminal of the fourth transistor and the control terminal of the second transistor is coupled to the third node; and a first compensating circuit coupled to the control terminal of the second transistor, the first node and the second node, configured to detect a threshold voltage of the second transistor.

3. The display device of claim 2, wherein the first compensating circuit comprises:

a fifth transistor comprising a first terminal, a second terminal and a control terminal, wherein the first terminal of the fifth transistor is coupled to the first node, the second terminal of the fifth transistor is coupled to the third node, and the control terminal of the fifth transistor is configured to receive a first switching signal; and a second capacitor coupled between the second node and the third node.

4. The display device of claim 1, wherein the pulse-width modulation circuit comprises:

a sixth transistor comprising a first terminal, a second terminal and a control terminal, wherein the second terminal of the sixth transistor is coupled to the control terminal of the second transistor, the first terminal of the sixth transistor is coupled to a fourth node;

a seventh transistor comprising a first terminal, a second terminal and a control terminal, wherein the second terminal of the seventh transistor and the first terminal of the fourth transistor are configured to receive a reference voltage together, and the control terminal of the seventh transistor and the control terminal of the fourth transistor are configured to receive a reset signal;

an eighth transistor comprising a first terminal, a second terminal and a control terminal, wherein the first terminal of the eighth transistor is configured to receive a third driving signal, the second terminal of the eighth transistor is coupled to the fourth node, and the control terminal of the eighth transistor is coupled to a fifth node;

a second compensating circuit coupled to the fourth node, the fifth node and the first terminal of the seventh transistor, configured to detect a threshold voltage of the eighth transistor;

a third capacitor comprising a first terminal and a second terminal, wherein the first terminal of the third capacitor is coupled to a sixth node, and the second terminal of the third capacitor is coupled to the fifth node;

a fourth capacitor comprising a first terminal and a second terminal, wherein the first terminal of the fourth capacitor is configured to receive the pulse signal, and the second terminal of the fourth capacitor is coupled to the sixth node; and a ninth transistor comprising a first terminal, a second terminal and a control terminal, wherein the first terminal of the ninth transistor is configured to receive a second data signal, the second terminal of the ninth transistor is coupled to the sixth node, and the control terminal of the ninth transistor is configured to receive a second write signal.

5. The display device of claim 4, wherein the second compensating circuit comprises:

a tenth transistor coupled between the fourth node and the fifth node, wherein a control terminal of the tenth transistor is configured to receive a first switching signal.

6. The display device of claim 5, wherein the pulse signal is configured to provide a ramp pulse.

7. The display device of claim 1, wherein when the first driving signal has the fixed voltage and the emitting signal repeatedly oscillates, the pulse signal provides a ramp pulse;

when the first driving signal repeatedly oscillates and the emitting signal provides the pulse, the pulse signal provides the ramp pulse.

8. The display device of claim 1, wherein the control circuit comprises:

an eleventh transistor comprising a first terminal, a second terminal and a control terminal, wherein the first terminal of the eleventh transistor is coupled to the second node, the second terminal of the eleventh transistor is configured to receive a first data signal, and a control terminal of the eleventh transistor is configured to receive a first write signal;

a twelfth transistor coupled between the control terminal of the second transistor and the pulse-width modulation circuit, wherein a control terminal of the twelfth transistor is configured to receive a first switching signal;

a thirteenth transistor coupled between the emission unit and the first node, wherein a control terminal of the thirteenth transistor is configured to receive a second switching signal;

a fourteenth transistor comprising a first terminal, a second terminal and a control terminal, wherein the second terminal of the fourteenth transistor is coupled to the first node, and the control terminal of the fourteenth transistor is configured to receive the first write signal; and a fifteenth transistor comprising a first terminal, a second terminal and a control terminal, wherein the second terminal of the fifteenth transistor and the first terminal of the fourteenth transistor are coupled to a seventh node, and the control terminal of the fifteenth transistor is configured to receive a reset signal.

9. The display device of claim 8, wherein the pulse-width modulation circuit comprises:

a fifth capacitor, wherein a first terminal of the fifth capacitor is configured to receive the second driving signal, and a second terminal of the fifth capacitor is coupled to the seventh node;

a sixteenth transistor comprising a first terminal, a second terminal and a control terminal, wherein the first terminal of the sixteenth transistor is configured to receive a second data signal, and the control terminal of the sixteenth transistor is configured to receive a second write signal;

a seventeenth transistor coupled between the sixteenth transistor and the seventh node; and a sixth capacitor, wherein a first terminal of the sixth capacitor is configured to receive the pulse signal, and a second terminal of the sixth capacitor is coupled to a control terminal of the seventeenth transistor.

10. The display device of claim 1, wherein if the first driving signal has the fixed voltage and the emitting signal provides the pulse in the first frame, each of the plurality of pixel circuits further comprises:

a seventh capacitor comprising a first terminal and a second terminal, wherein the first terminal of the seventh capacitor is coupled to the control terminal of the second transistor, and the second terminal of the seventh capacitor is configured to receive a fourth driving signal which repeatedly oscillates in the first frame; wherein the control circuit further comprises:

an eighteenth transistor comprising a first terminal, a second terminal and a control terminal, wherein the first terminal of the eighteenth transistor is coupled to the first node, the second terminal of the eighteenth transistor is configured to receive a reference voltage, and the control terminal of the eighteenth transistor is configured to receive a reset signal; and a nineteenth transistor comprising a first terminal, a second terminal and a control terminal, wherein the first terminal of the nineteenth transistor is coupled to the first node, the second terminal of the nineteenth transistor is coupled to the control terminal of the second transistor, and the control terminal of the nineteenth transistor is configured to receive a first switching signal.

11. The display device of claim 10, wherein the pulse-width modulation circuit comprises:

a twentieth transistor comprising a first terminal, a second terminal and a control terminal, wherein the first terminal of the twentieth transistor is configured to receive a third driving signal, and the control terminal of the twentieth transistor is coupled to an eighth node;

a twenty-first transistor comprising a first terminal, a second terminal and a control terminal, wherein the first terminal of the twenty-first transistor is coupled to a ninth node, and the second terminal of the twenty-first transistor is coupled to the second terminal of the seventh capacitor;

a twenty-second transistor coupled between the eighth node and the ninth node, wherein a control terminal of the twenty-second transistor is configured to receive a third switching signal; and an eighth capacitor, wherein a first terminal of the eighth capacitor is configured to receive the pulse signal, and a second terminal of the eighth capacitor is coupled to the eighth node.

12. The display device of claim 10, wherein when the fourth driving signal repeatedly oscillates, the pulse signal provides a ramp pulse.

13. A driving method applicable to a display device supporting variable refresh rate, wherein the display device comprises a plurality of pixel circuits, and the method comprises:

adjusting a plurality of control signals according to a first display data such that the plurality of pixel circuits generate a first frame;

receiving a second display data generated after the first display data, wherein the display device receives the first display data and receives the second display data after a time duration of the first frame has passed; and adjusting the plurality of control signals according to the time duration of the first frame such that the plurality of pixel circuits generate a second frame, wherein the plurality of pixel circuits are lit during a preset time interval in each frame of the display device, and brightness of each of the plurality of pixel circuits is positively correlated to a duty ratio of a corresponding one of the plurality of control signals, and an increment of the duty ratio of the corresponding one of the plurality of control signals in the second frame is negatively correlated to a difference between a ratio of the preset time interval to the time duration of the first frame, and a ratio of the preset time interval to a time duration of the second frame.

14. The driving method of claim 13, wherein the display device completes displaying the first frame and receives the second frame after a blank time interval has passed, and the increment of the duty ratio of the corresponding one of the plurality of control signals is positively correlated to a ratio of the blank time interval to the time duration of the first frame.

15. The driving method of claim 13, wherein the plurality of pixel circuits forms a pixel matrix having N rows, and the display device disable each of the plurality of pixel circuits to complete displaying the first frame, or the display device sequentially disables the plurality of pixel circuits from a first row to an N-th row, and completes displaying the first frame when the N-th row of the plurality of pixel circuits is disabled.

16. The driving method of claim 13, wherein each of the plurality of pixel circuits comprises a first transistor and an emission unit connected in series, and a control terminal of the first transistor is configured to receive the corresponding one of the plurality of control signals, such that the first transistor is intermittently conducted corresponding to the duty ratio of the corresponding one of the plurality of control signals.

17. The driving method of claim 13, wherein each of the plurality of pixel circuits comprises an emission unit, and the emission unit is configured to receive the corresponding one of the plurality of control signals, such that the emission unit is intermittently conducted corresponding to the duty ratio of the corresponding one of the plurality of control signals.

18. The driving method of claim 17, wherein each of the plurality of pixel circuits further comprises a second transistor and a seventh capacitor, and the second transistor is configured to drive the emission unit, and a control terminal of the second transistor is configured to receive the corresponding one of the plurality of control signals through the seventh capacitor, such that the second transistor is intermittently conducted corresponding to the duty ratio of the corresponding one of the plurality of control signals.

* * * * *